US007874247B2

(12) United States Patent
Wideäll

(10) Patent No.: US 7,874,247 B2
(45) Date of Patent: Jan. 25, 2011

(54) WASTE BIN HAVING COMPACTING MEANS

(75) Inventor: Emma Wideäll, Västra Frölunda (SE)

(73) Assignee: SCA Hygiene Products AB, Gothenburg (SE)

( * ) Notice: Subject to any disclaimer, the term of this patent is extended or adjusted under 35 U.S.C. 154(b) by 369 days.

(21) Appl. No.: 12/091,774

(22) PCT Filed: Oct. 28, 2005

(86) PCT No.: PCT/SE2005/001627

§ 371 (c)(1),
(2), (4) Date: Apr. 28, 2008

(87) PCT Pub. No.: WO2007/050003

PCT Pub. Date: May 3, 2007

(65) Prior Publication Data

US 2008/0282911 A1 Nov. 20, 2008

(51) Int. Cl.
*B30B 15/06* (2006.01)
*B30B 7/00* (2006.01)

(52) U.S. Cl. ..... 100/229 A; 100/233; 100/292

(58) Field of Classification Search ..... 100/229 A, 100/233, 238, 247, 281, 292, 295; 220/826
See application file for complete search history.

(56) References Cited

U.S. PATENT DOCUMENTS

| | | | | |
|---|---|---|---|---|
| 2,392,604 | A | | 1/1946 | Mallory |
| 3,285,505 | A | | 11/1966 | Katz |
| 3,919,932 | A | * | 11/1975 | Basuino ..... 100/228 |
| 4,188,876 | A | * | 2/1980 | Graves ..... 100/232 |
| 4,286,515 | A | | 9/1981 | Baumann et al. |
| 5,421,252 | A | * | 6/1995 | Reichel ..... 100/193 |
| 5,440,978 | A | | 8/1995 | O'Brien et al. |
| 5,845,567 | A | * | 12/1998 | Fischer ..... 100/226 |
| 5,884,556 | A | * | 3/1999 | Klepacki et al. ..... 100/349 |
| 2003/0121425 | A1 | | 7/2003 | Blatz |

FOREIGN PATENT DOCUMENTS

| | | |
|---|---|---|
| AU | 656394 | 1/1993 |
| DE | 4241123 | 6/1994 |
| EP | 0 006 242 | 1/1980 |
| EP | 0 532 848 | 3/1993 |
| JP | 10007204 | 4/1998 |
| JP | 2002037402 | 2/2002 |
| JP | 2002114306 | 4/2002 |
| SU | 269003 A | 8/1946 |

OTHER PUBLICATIONS

EP Office Action dated Jan. 30, 2009 from corresponding EP 05797025.
Decision on Grant in Corresponding Russian Patent Application No. 2008121229.

* cited by examiner

*Primary Examiner*—Jimmy T Nguyen
(74) *Attorney, Agent, or Firm*—Young & Thompson

(57) ABSTRACT

The present invention relates to a waste bin (1) for used paper towels or the like waste having an upper part including a rear wall (2), two side walls (4.5), and a front wall (3), which upper part include compacting means (6,7). According to the invention the compacting means (6,7) in its rest position divides the inner space of the waste bin (1) into an upper (8) and lower compartment (9) and are movable to open and re-close an opening into a lower part of the waste bin.

16 Claims, 4 Drawing Sheets

WASTE BIN HAVING COMPACTING MEANS

CROSS REFERENCE TO RELATED APPLICATIONS

This application is the 35 U.S.C. §371 national stage of International PCT/SE2005/001627 filed on Oct. 28, 2005. The entire contents of each of the above-identified applications are hereby incorporated by reference.

TECHNICAL FIELD

The present invention relates to a waste bin for used paper towels or the like having an upper part including a rear wall, two side walls and a front wall, which upper part include compacting means.

BACKGROUND OF THE INVENTION

In many public facilities, such as toilets in air ports, railway stations, hotels, department stores, etc., dispensers for paper towels are installed. Large such facilities can have between 500-1000 visitors during an eight hours period of time. In order to reduce the times the dispensers for paper towels have to be refilled during such a period, there is a tendency to construct dispensers to hold ever more towels. However, there is not much gained by larger dispensers if not the waste bins for paper towels can store the increased amount of used paper towels. There is therefore a need for a waste bin that can store a lot more used paper towels than conventional waste bins and still have a moderate size.

It is known in prior art to use compacting devices in waste bins or garbage containers in order to decrease the volume of used paper towels or other waste thrown into the bin so that the bins or containers can contain a lot more used paper towels or other waste. Many of the known compacting devices consist of protruding parts on lids which compact the waste in the bin when the lid is closed, see for example EP-B1-0 006 242, and U.S. Pat. No. 5,440.978. U.S. Pat. No. 5,884,556 disclose a compacting devices mounted in a separate housing that can be introduced into a trash container in order to compact the content therein.

Patent abstracts of Japan No. 10-007204 discloses a trash box having a cover which automatically opens when trash falls thereon and a pushing plate which turn from a standing position to a downward position. The cover, pushing plate and their mechanisms are disposed in separate unit detachable from the rest of the trash box. A drawback with this known trash box is that the cover, pushing plate and their mechanisms take up a lot of the available space in the box. It is also relatively cumbersome to empty the box from trash.

The objective of the present invention is fill the above mentioned need by providing a waste bin with compacting means in which the compacting means does not significantly reduce available space inside the bin and which enables the emptying of the bin to be performed fast and easily.

SUMMARY OF THE INVENTION

This objective is accomplished by a waste bin for used paper towels or the like waste having an upper part including a rear wall, two side walls and a front wall, which upper part include compacting means, characterized in that the compacting means in its rest position divides the inner space of the waste bin into an upper and lower compartment and are movable to open and re-close an opening into a lower part of the waste bin.

In a preferred embodiment the compacting means consist of at least one plate, which from said closed rest position performs a rotational and linear movement to open and re-close said opening into the lower compartment, whereby said plate is turned upside-down during the movement from closed to re-closed position. The at least one plate is only rotating in one direction during successive movements from closed to re-closed position. Advantageously, the at least one plate is essentially rectangular and the corners of said plate move along essentially straight linear paths during the opening phase and one pair of opposing corners on said plate moves along an arc of a circle during the re-closing phase, whereby the other pair of opposing corners constitutes a rotational axis for the plate during the re-closing phase. Furthermore, has the at least one plate has steering pins protruding from the corners thereof in a direction towards an adjacent side wall, said side walls including guiding rails in which said steering pins are running. Said guide rails in said side walls are continuous and have a triangular shape. A cam curve for the at least one plate exists in at least one of said side walls and the at least one plate has a follower co-operating with said cam curve.

In a first alternative the at least one plate extend horizontally in its closed and re-closed position.

In a second alternative the at least one plate slops downwardly from the front or rear wall in its closed and re-closed position.

Drive means for the at least one plate are preferably supported by a side wall in the waste bin, said drive means include at least one electric motor controlled by electronic control means.

In the most preferred embodiment the compacting means include two plates rotating in opposite directions during their movement from closed to re-closed position.

The lower compartment of the waste bin includes advantageously a removable container, which can be taken away from the bin after opening or displacement of a lower portion of the front or rear wall.

The entire movement of the compacting means between closed and re-closed position takes place within said upper compartment.

BRIEF DESCRIPTION OF THE DRAWINGS

The invention shall now be described with reference to the enclosed Figures, of which.

DESCRIPTION OF EMBODIMENTS

Figure 1:
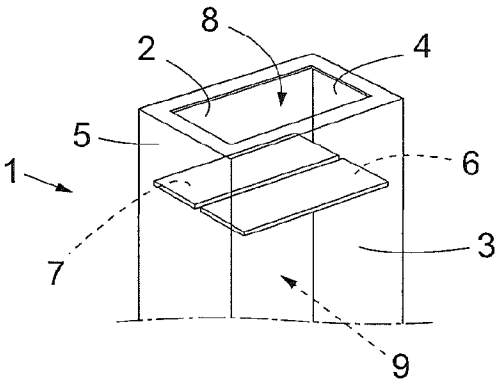
FIG. 1 schematically discloses a perspective view of the upper part of a waste bin according to a preferred embodiment of the invention, FIG. 2*a-g* schematically disclose the movements of the compacting plates disclosed in the waste bin according to FIG. 1, FIG. 3-6 schematically disclose the mechanism for moving the compacting plates in a preferred embodiment of the invention, and FIG. 7 schematically discloses a perspective view of a waste bin according to the preferred embodiment with a lower portion of the bin displaced from the remaining part thereof.

In FIG. 1 a schematic perspective view shows the upper part of a preferred embodiment of a waste bin 1 according to the present invention. The waste bin 1 comprises a rear wall 2, a front wall 3 and two side walls 4 and 5. The waste bin further includes compacting means in the form of two moveable compacting plates 6,7, which in their rest position are horizontal and divide the waste bin in an upper compartment 8 and a lower compartment 9. In FIG. 1 the walls 2-5 are shown as being transparent in order to enable viewing of the compacting plates 6,7 in FIG. 1. Normally these walls are made of opaque material.

Figure 2:
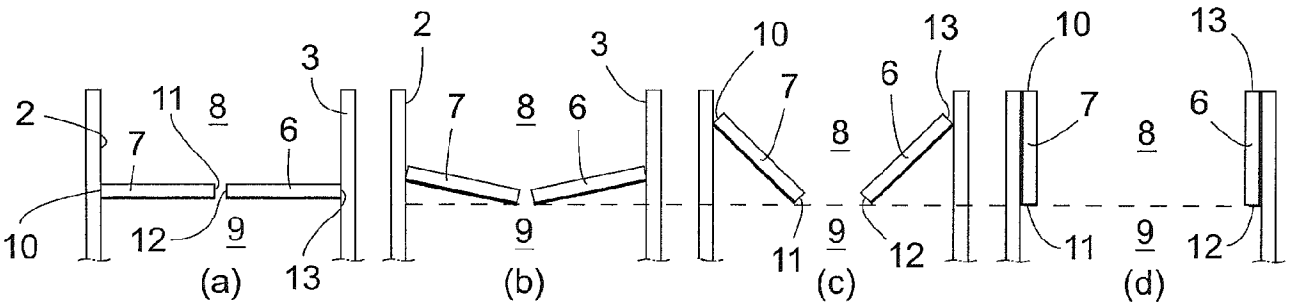
Figure 2:
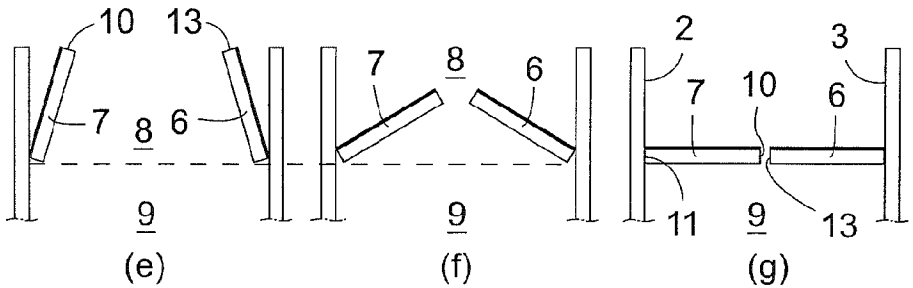

In FIGS. 2(*a*)-2(*g*) the movements of the compacting plates 6,7 from a closed rest position, in which the plates 6,7 constitutes the bottom of the upper compartment 8, to an open position and back to the rest position are schematically shown. The respective opposite longitudinal edges of the plates 7, 6 are designated 10, 11 and 12,13, respectively.

In FIG. 2(*a*) the plates 6,7 are shown in their closed rest position. When the mechanism for operating the movement of the plates 6,7 is activated, the respective plates moves so that the longitudinal edges 10,13 of the respective plate adjacent to a side wall 5 and 4, respectively moves upward while at the same time the longitudinal edges 11, 12 of the respective plates distal from the side walls moves in a direction towards the respective side wall 5 and 4, respectively. This movement pattern continues (see FIGS. 2(*b*) and (*c*)) until a side of the plates 6,7, i.e the in FIG. 2(*a*) lower side of the plates, abut against the respective side wall 5,4, which position is shown in FIG. 2(*d*). During the movement of the plates between the positions shown in FIGS. 2(*a*) to 2(*d*), i.e. the opening phase of the plate movement, all used paper towels or the like waste existing in the upper compartment 8 in the waste bin 1 will fall down into the lower compartment 9 of the bin.

From the positions shown in FIG. 2(*d*), the plates 7, 6 are swung down to a horizontal position shown in FIG. 2(*g*). As is evident from FIGS. 2(*d*)-2(*g*) this swinging movement is a true rotational movement. During this movement, i.e. the re-closing phase of the movement, any used towels or the like waste that protrude upwards from the lower compartment 9 of the bin will be pressed down into said lower compartment by the plates 6,7. During the movement from the position shown in FIG. 2(*a*) to the position shown in FIG. 2(*g*) the plates 6,7 have been turned upside-down so that the longitudinal edges 10, 13 of the respective plate being adjacent to the respective side wall 5,4 in the position shown in FIG. 2(*a*) are distal to the side walls in the position shown in FIG. 2(*g*). During a next activation of the mechanism for moving the plates 6,7 they will move in a pattern similar to the pattern shown in FIGS. 2(*a*)-2(*g*) and end in the position shown in FIG. 2(*a*) with longitudinal edges 10,13 of the respective plate 7 and 6, respectively again being adjacent to the respective side wall 5,4. During all their movements, the plates 6,7 only move in the upper compartment 8 of the waste bin 1. As is evident from the FIGS. 2(*a*)-2(*g*) and the explanations above, the rotational direction for each plate is always the same, plate 7 rotate clockwise whereas plate 6 rotate anticlockwise.

When used paper towels are thrown in the waste bin, they will at first be prevented from falling into the lower compartment 9 by the compacting plates, at the beginning being in the position shown in FIG. 2(*a*) or 2(*g*). When a certain amount of used towels have piled up in the upper compartment 8 or a certain time has elapsed, the compacting plates are activated to perform their movements in accordance with FIGS. 2(*a*)-2(*g*). Used towels from compartment 8 will then drop down into the lower compartment 9. When the upper compartment 8 again is filled or a certain time again has elapsed, the plates are again activated to perform their pattern of movements. This sequence of events will be repeated over time. After a certain times of emptying used towels from the upper compartment into the lower compartment, the towels filled into the lower compartment will fill up this compartment and the towels then thrown into the upper compartment will remain therein during the movement of the compacting plates from position 2(*a*) to 2(*d*) in FIG. 2 in which position the plates have a vertical extension abutting the side walls of the upper compartment. During the swinging movement of the plates from the position shown in FIG. 2(*d*) to the position shown in FIG. 2(*g*), the towels in upper compartment 8 will be compacted by the plates and pressed into the lower compartment 9. This sequence of events will continue until the towels in the lower compartment are maximally compacted or until the lower compartment is emptied. By the term "maximally compacted" means that either the press force of the plates is too small to further compact the towels or that the volume taken up by the towels have been reduced to a maximum degree. The lower compartment of the bin preferably holds a bag or the like into which the used towels from the upper compartment will fall in order to facilitate emptying of the waste bin.

Preferably, the waste bin is so designed that it can hold an amount of used hand towels equal or more than the amount estimated to be thrown into the bin during the period between two service intervals of the room in which the waste bin is disposed. In such a case, the used towels thrown into the upper compartment will be held therein during the emptying of the lower compartment. Otherwise, if safety precautions not are taken, the compacting plates will be stuck in a position between positions 2(*d*) and 2(*g*) in FIG. 2 and there is a risk that used paper towels will fall down to the bottom of compartment or to the floor when the bag in the lower compartment is taken out thereof. Such towels will cause extra work for the personnel serving the waste bin. The mechanism for moving the compacting plates is controlled by an electronic control unit and in order to prevent the risk for emptying towels from the upper compartment outside the bag in the lower compartment, the control unit can be arranged to stop further activation of said mechanism when the compacted towels in the lower compartment exert a certain pressure on the compacting plates. At the same time, the inactivation of said mechanism can also trigger a marking, such as a red light, indicating that the waste bin should be emptied.

As stated above, the activation of the moving mechanism for the compacting plates can preferably be controlled by a timer so that the mechanism is activated after a certain time interval, for example every ten minutes, the upper compartment then being dimensioned to hold used towels in an amount corresponding to the estimated amount of towels being used per such time interval. To conserve battery energy, the control unit can preferably comprise "high load" and "low load" settings, where "high load" setting is the aforesaid certain time interval of e.g. ten minutes, and the "low load" setting can be much longer, e.g. an hour or even longer, to be used during nights and weekends when there are very few visitors to the locality in which the waste bin is placed.

However, the automatic activation of the moving mechanism for the compacting plates can also be controlled by means, such as photocells or the like, detecting when the upper compartment is filled with used towels.

If the waste bin is placed near to and serves one or more dispensers, which can send electronic signals, by cable or e.g. IR-link, indicating towels being drawn from the dispenser(s), the waste bin control unit can use these signals to count the amount of towels being drawn and activate the moving mechanism for the compacting plates when a predetermined number of towels have been drawn.

Such dispensers can be measuring number of towels drawn or length of towels drawn.

If the waste bin serves only one such dispenser, the counting can be done by the dispenser control unit, which then can send an activating signal to the waste bin control unit.

Furthermore, the waste bin is preferably also provided with a button or the like coupled to the control unit for the activation of the moving mechanism for the compacting plates so that activation thereof can be manually performed. This will allow service personnel to empty the upper compartment from possible used towels contained therein into the lower compartment before the emptying thereof.

Figure 3:
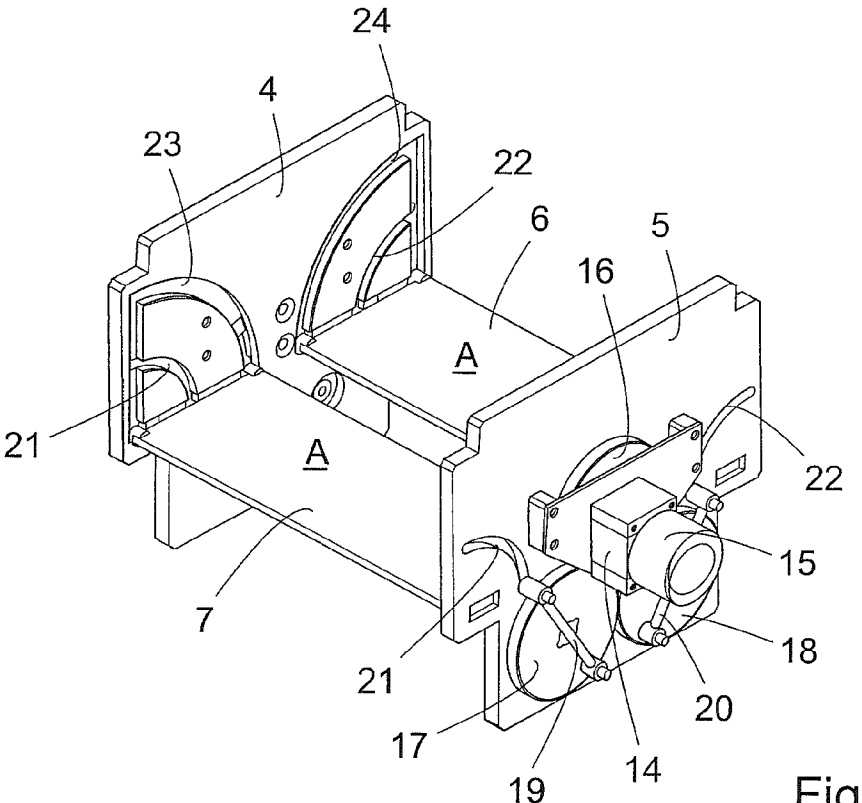
Figure 6:
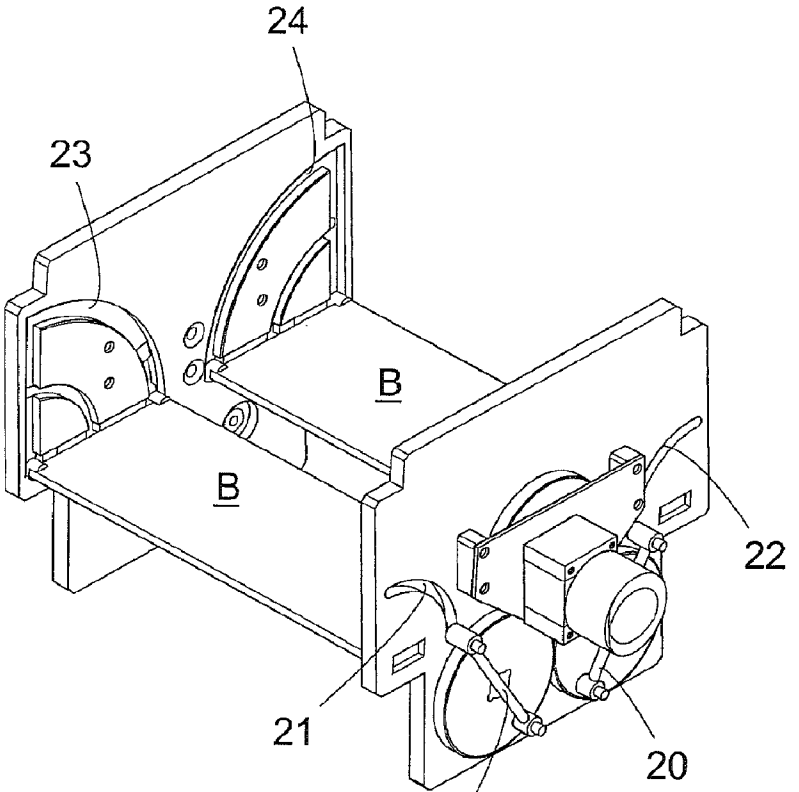

In FIGS. 3-6 a mechanism 14 for moving the compacting plates 6, 7 in a perspective view from above is schematically shown with the plates in different positions. FIG. 3 discloses the compacting plates in a position corresponding to the position in FIG. 2(*a*), FIG. 4 discloses the compacting in a position corresponding to FIG. 2(*b*), FIG. 5 discloses the compacting plates in a position corresponding to FIG. 2(*d*) and FIG. 6 discloses the compacting plates in a position corresponding to FIG. 2(*f*). In FIGS. 3-6, the walls of the bin are not shown, except for a part of each side wall 4,5 which are supporting mechanism 14 and contain means for steering the compacting plates 6,7.

Mechanism 14 comprises an electric motor 15, a driven gear wheel 16 affixed to the output shaft of the motor 15 and two identical gear wheels 17,18 in engagement with each other. Gear wheel 17 is in engagement with gear wheel 16 and driven thereby. A rod 19, 20 is with one of its ends rotatably attached to each gear wheel 17,18 near the outer periphery thereof. The other ends of the rods 19,20 runs in a steering groove 21 and 22, respectively, said grooves being cut through the side wall 5. The ends of rods 19,20 running in steering grooves are rotatably attached to the respective compacting plate 6,7. These articulate connections between said ends of rods 19,20 and the adjacent short side of the respective plate 6,7 are positioned in the middle point of the short side of the respective plate 6,7. By a short side of the plate is herein meant the side thereof turned against a side wall, independent of the dimensions of the plates. As is evident from FIG. 3 both side walls 4,5 is provided with steering grooves 21,22 and both short sides of each compacting plate have pins or the like running in said steering grooves. Furthermore, each corner of each short side of each plate 6,7 has a corner stud or corner pin protruding from the respective short side in the longitudinal direction of the plates, i.e. towards the adjacent side wall 4,5. On each side wall 4,5 triangular guide rails 23,24 are disposed (only the guide rails on side wall 4 is shown in FIGS. 3-6) in which guide rails said corner pins are guided. The triangular shape of the guide rails is formed by straight horizontal and vertical catheters and a curved hypotenuse joining together the free ends of the catheters. The curved hypotenuse consists of an arc of a circle. The guide rails are disposed with their hypotenuses turned against each other and with one catheter being horizontal and the other accordingly being vertical, as can bee seen in FIGS. 3-6. In each horizontal corner of the said triangular shape of the guide rails 23, 24, means are disposed for creating a restriction force for movement of the corner pins in the rails. These means can consist of snap locks or friction means enhancing friction between the corner pins and the rails or the side wall. The function of these means will be explained in the following.

Figure 4:
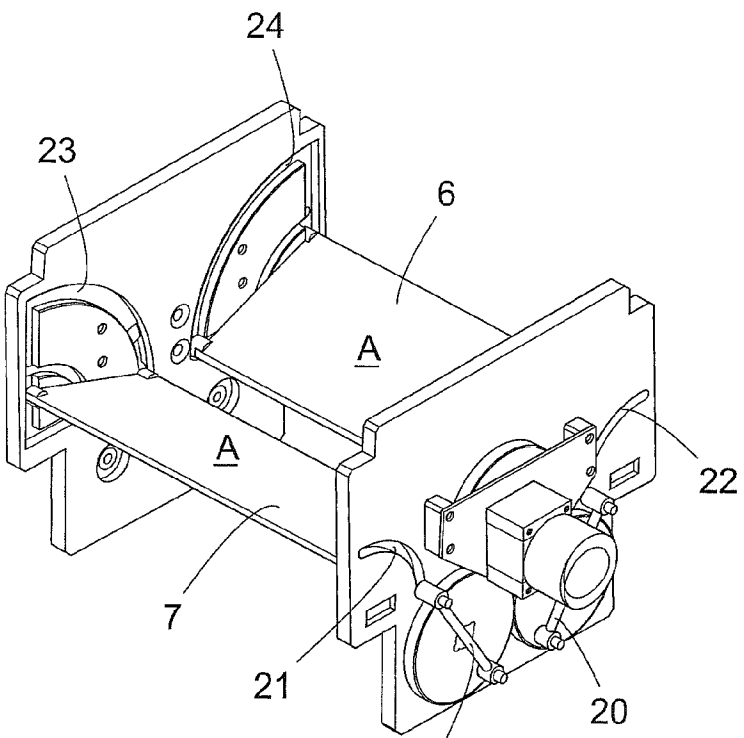

In FIG. 3, the compacting plates are shown in the closed rest position and the motor 15 is not running. When the motor 15 is activated by the electronic control unit (not shown in the Figures), the gear wheels 17, 18 begin to rotate in the directions illustrated by arrows in the Figures and upper ends of rods 19,20 begin to move upward in the respective grooves 21, 22 bringing the compacting plates with them via the articulated connection to the middle of the short sides thereof. The snap locks or the like in the horizontal corners are so arranged that the restriction force created thereby is greater in the horizontal corners between the hypotenuse and the horizontal catheter than in the corners between the catheters in the respective triangular guide rail 23, 24. Thereby the outer longitudinal edge parts of the respective plate 6,7 adjacent to the rear and front wall, respectively of the bin is easier to move than the opposite inner parts. By this arrangement it is ensured that the corner pins of the respective plate 6,7 will move in the catheter parts of the guiding rails and not in the hypotenuse parts. Thus, the activation of motor 15 will lead to that plates 6,7 will rotate around the inner corner pins while these pins simultaneously move outwards, i.e. towards the rear and front wall, respectively, in the guide rails. In FIG. 4 is shown the position of the plates a short time after activation of motor 15.

Figure 5:
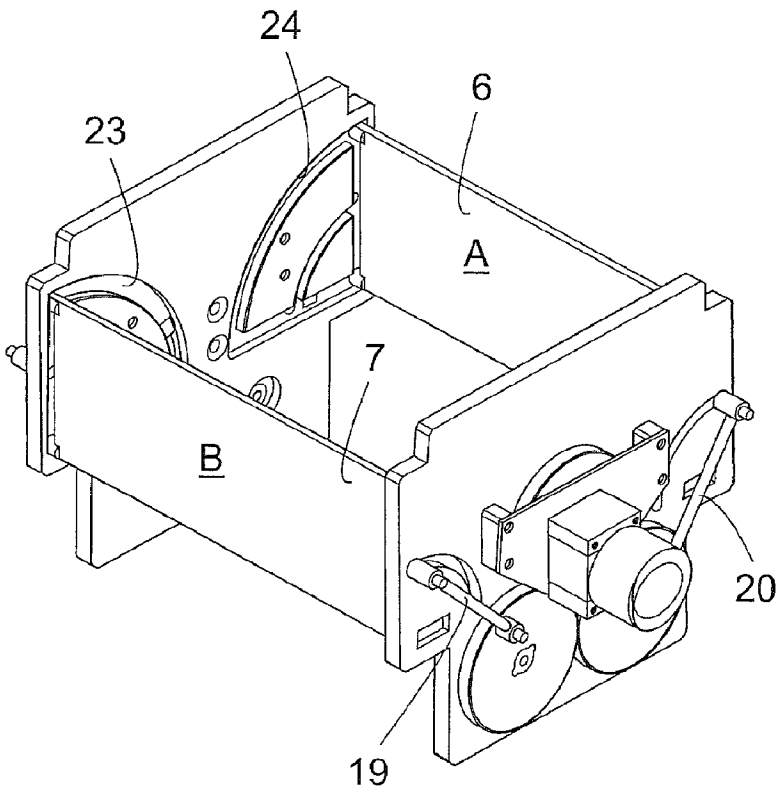

In FIG. 5, the upper ends of the rods 19, 20 has reached the upper ends of steering grooves 21, 22 and the compacting plates has been brought to a vertical position abutting the rear and front wall, respectively. In this vertical position, the corner pins of the compacting plates 6,7 being distal from the rear and front wall, respectively, in FIG. 3 have been moved into the corners between the catheters in the respective triangular guide rails 23,24 and into the snap locks or the like arranged in these corners. The further rotation of the gear wheels 17,18 will make the upper ends of the rods 19, 20 to move downwards in the steering grooves 21, 22 from the upper ends thereof. This will make the compacting plates swing in a downward direction, the corner pins of the plates that in the position shown in FIG. 5 are disposed in the corners between the vertical catheters and the hypotenuses of the guide rails, being guided in the curved part of the respective rail. The restriction force acting on the corner pins disposed in the corners between catheters, by the snap locks or the like in these corners will ensure such a movement of the plates.

When the plates has moved down to horizontal position with the corner pins on the respective plate again resting in the snap locks as in the position shown in FIG. 3, one cycle of the movements of the compacting plates has been completed and the motor 15 is deactivated by the electronic control unit. The position of the compacting plates 6,7 in FIG. 6 correspond to the position shown in FIG. 3, the only difference being that the side of the plates which in FIG. 3 is turned upward is turned downward in FIG. 6. The opposite sides of the plates 6,7 have in FIGS. 3-6 been indicated by "A" and "B", respectively.

The plates 6,7 have been disclosed with rectangular cross-section. Cross-sections of other shapes are of course possible. For example, the plates can be thicker in the middle thereof. The sides of the plates need not have smooth surfaces but can have a rough or rugged surface. The plates need neither be exactly rectangular, it is possible to give the plates a slight hour-glass shape in order to prevent towels from the lower compartment being influenced of the plates during their movement in the opening phase.

If the waste bin 1 is not emptied in time, the amount of used towels in the lower compartment of the bin will reach such an amount that they can not be compacted any further by the compacting plates. Such a state can be reached either when the towels are compacted to what is physically possible or when the maximal torque of the motor is reached. If the activation of the motor is continued in such a state, the motor will be damaged. For this reason, the mechanism for moving the compacting plates is preferably provided with means to deactivate the electric motor 15 if the counter pressure from used towels in the lower compartment of the waste bin 1 exceeds a certain value. One way of accomplishing such means is to sense the current fed to the motor and deactivate the motor when the current exceeds a certain value. Another way can be to register a horizontal position of the compacting plates in any suitable way, such as position indicators in the horizontal corners of the guide rails. If one of or both the plates do not reach their horizontal positions in a certain time, the motor 15 is deactivated. A third way can be to estimate the time for one cycle of plate movements when the counter force of used towels in the lower compartment is as high as allowed and thereby decide a maximal allowed activation time for motor 15.

It is pointed out that for safety reason it is preferred that the maximum torque of the motor 15 is not so high that a hand caught between downwards swinging plates can not be taken back or be so high that the hand can be damaged. In order to further reduce the risk for such damage an element of soft material, such as rubber or the like, can be affixed to the longitudinal edge portions of the plates.

It is essential for the proper function of the mechanism according to the preferred embodiment and described with reference to FIGS. 3-6, that the downward swinging movement of the compacting plates 6,7 is completed before the motor 15 is deactivated. For this reason, at least position indicators should be present in the corners between the horizontal catheter and the hypotenuse of each triangular guide rail in order to verify that corner pins of the compacting plates are present in these corners of the guide rails before the motor 15 is stopped.

The waste bin 1 can be provided with a mechanism similar to the mechanism 14 described with reference to FIGS. 3-6 also on the opposite side wall 4. In such a case the running of the electrical motors of these two mechanisms should be synchronized.

The corner pins of the compacting plates 6,7 comprise advantageously rolls rotatably attached thereto in order to smoothly run in the guide rails 23, 24. Such rolls can be of a somewhat resilient material in which case the restriction forces in the horizontal corners of the guide rail can be created by reducing the distance between the two protruding ribs making up the guide rails.

The mechanism 14 can of course be modified without leaving the scope of invention. For example can the gear wheels 16,17,18 be substituted by friction wheels, i.e. wheels having a frictional coating on the peripheral surfaces thereof. In such a case, the risk for damage of the motor when the counter pressure from used towels in the lower compartment is higher than the maximal press force of the compacting plates is reduced.

It is of course also possible to use separate drive mechanisms for each plate. It is also possible to provide separate motors for the rotational movement of the plates which then should be synchronized with the motors for the reciprocating movement central longitudinal axis of the plates in the steering grooves. In such a case the snap locks or the like in the horizontal corners of the guide rails can be deleted.

Figure 7:
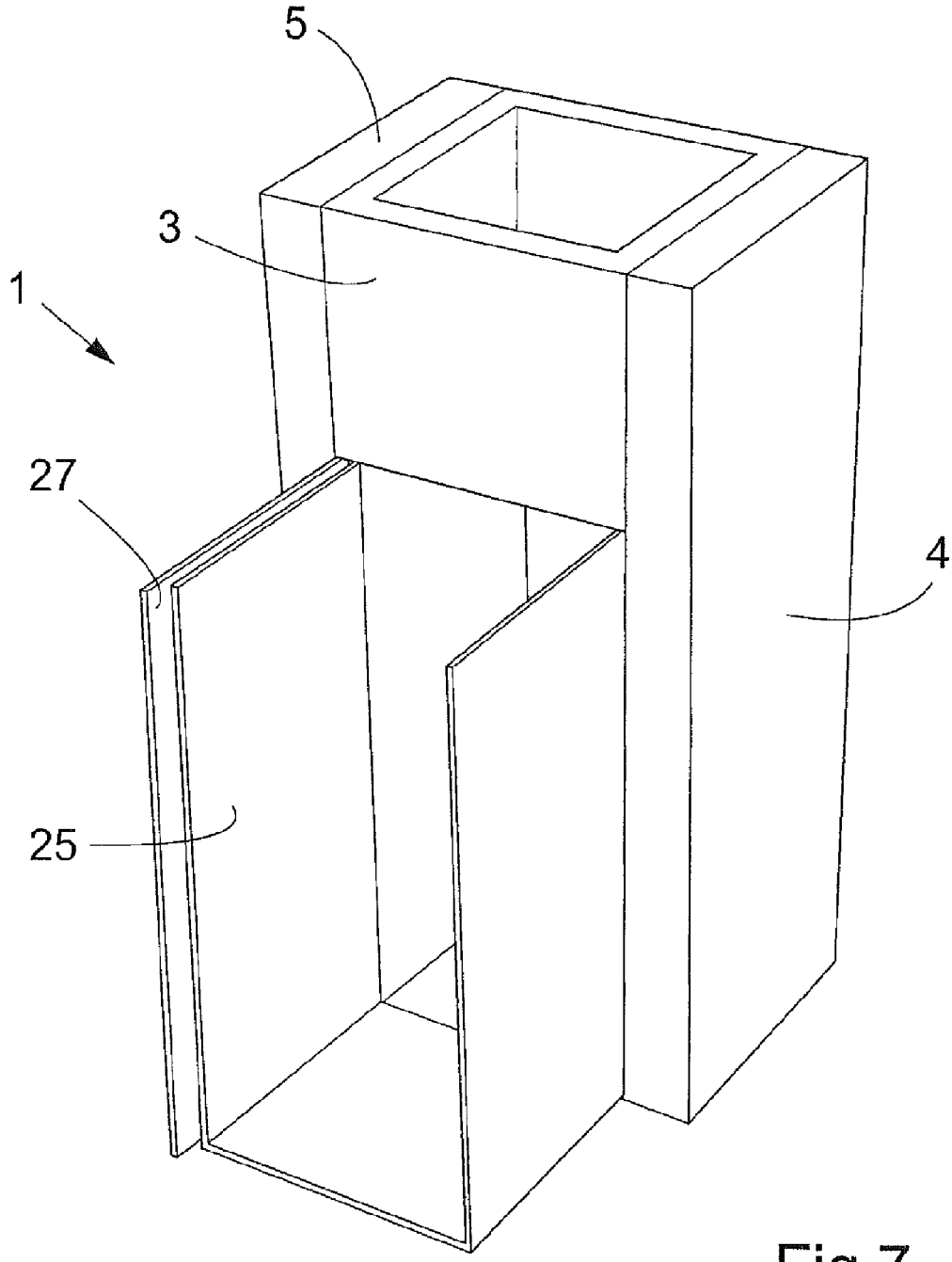

The side walls of the waste bin 1 are preferably of a double wall construction so that the moving mechanism 14, the electronic control unit and a power unit, such as one or more batteries, can be contained between these walls. FIG. 7 shows a schematic perspective view of the preferred embodiment of the waste bin 1. In this embodiment the lower compartment of the waste bin includes a bag holding unit 25 which can be taken out of the waste bin trough a door 27 in the front wall 3. The bag holder 25 comprises a rear wall, two side walls and a bottom wall and the opening portion of a bag (not shown in the Figure) can be folded over the upper edges of the rear wall and the side walls. The door allowing access to the bag holder can of course be disposed in the rear wall of the waste bin instead of in the front wall as shown in FIG. 7.

The bag holder can of course have other configurations. For example, the side walls can be deleted from the configuration shown in FIG. 7 and the upper part of the rear wall of the holder can then have a ring shaped member thereon over which the opening portion of a bag can be folded. The rear wall of the bag holder can constitute a part of the rear wall of the waste bin in which case a door in the front wall thereof will not be needed. The bag holder according to FIG. 7 can be provided with a front wall and be so dimensioned that the front and rear walls of the bag holder can constitute parts of the front and rear wall of the waste bin. The waste bin can also have a stationary lower compartment and a portion of the upper part disposed between the side walls and containing the upper compartment of the bin can be removable, for example hinged to the front or rear wall of the stationary lower compartment. In such a case, the bag will be lifted out of the bin when the lower compartment is to be emptied.

Compacting of paper towels can be more effectively performed if the towels are in a wet condition. Although the used paper towels thrown into the waste bin contains water the amount thereof is too small, about 1-2 ml of water in each towel, to create an ideal condition for effective compacting. It would therefore be advantageous if a spray device can be provided in the upper compartment for moistening the used paper towels before they are emptied from the upper compartment into the lower compartment. Such a spray device will thus be activated immediately before activation of the motor for moving the compacting plates. Water tanks for the spray device could be arranged between the double walls making up the side walls. Another possibility would be to connect the spray device to the cold water pipes in the room in which the waste bin is placed. In such a case, the waste bin is preferably wall mounted. The amount of water fed to the paper towels in the upper compartment should not be so large that water will be pressed out of the towels during the compacting thereof. The risk for water to be pressed out of the towels depend on compacting force and paper quality and the amount of water fed to the towels can be empirically determined.

It is also possible to let the plates and their moving mechanism be disposed in a separate unit, which is placed in the bottom of a container. Such a unit will so to speak "float" on the pile of used towels and lift itself during the compacting phase when used towels are pressed into the space under such a unit. In such a construction the compacting force will be equal within the whole waste bin and the vertical position of such a unit will indicate the amount of towels being compacted. An advantage of such a "floating" unit is that the compacting degree will be uniform within the waste bin. The compacting force of such a unit will be dependent on the weight thereof. If such a weight is inadequate to obtain the desired compacting degree, the unit can be controlled by a telescoping unit successively stepwise lifting the unit in small steps.

The compacting plates of a waste bin according to the present invention takes very little place and allow whole of the upper and lower compartments to be used for storage of used paper towels. Moreover, since the compacting plates in their horizontal position ensures that no used towels from the lower compartment extend into the upper compartment, the emptying of the lower compartment by sideways removing the bag holder from the lower compartment will be swift and easy.

The described embodiments can of course be modified in several aspects without leaving the scope of invention. For example, instead of a bag holder the lower compartment can be constituted by a container of disposable material, such as cardboard or the like. The waste bin can have another shape than the shape disclosed in FIG. 7. The electric motor can be encapsulated and separate from the remaining parts of the moving mechanism and connected to driving gear wheel by a magnetic coupling or the like. It is also possible to use only one plate instead of two plates as in the described embodiments. If desired, the plate or plates can in the rest position slope downwards from the adjacent front or rear wall. Furthermore, the horizontal and vertical rails which guide the plates during the opening phase of their movement need not be straight but can have a slight curvature. The invention should therefore only be limited by the wording of the enclosed patent claims.

The invention claimed is:

1. Waste bin for used paper towels comprising:

an upper part including a rear wall, two side walls, and a front wall;

said upper part including compacting means;

said compacting means in a closed rest position dividing the inner space of the waste bin into an upper compartment and a lower compartment, and being movable to open and re-close an opening into a lower part of the waste bin;

said compacting means consisting at least one plate, which from said closed rest position performs a rotational and linear movement to open and re-close said opening into the lower compartment, whereby said plate is turned upside-down during the movement from said closed rest position to a re-closed position.

2. The waste bin according to claim 1, wherein said at least one plate is only rotating in one direction during successive movements from said closed rest position to a re-closed position.

3. The waste bin according to claim 2, wherein said at least one plate is essentially rectangular and the corners of said plate move along essentially straight linear paths during an opening phase and one pair of opposing corners on said plate moves along an arc of a circle during a re-closing phase, whereby the other pair of opposing corners constitutes a rotational axis for the plate during the re-closing phase.

4. The waste bin according to claim 3, wherein said at least one plate has steering pins protruding from the corners thereof in a direction towards an adjacent side wall, said side walls including guiding rails in which said steering pins are running.

5. The waste bin according to claim 4, wherein said guide rails in said side walls are continuous and have a triangular shape.

6. The waste bin according to claim 3, further comprising a cam curve for said at least one plate exists in at least one of said side walls, and said at least one plate having a follower co-operating with said cam curve.

7. The waste bin according to claim 4, further comprising a cam curve for said at least one plate exists in at least one of said side walls, and said at least one plate having a follower co-operating with said cam curve.

8. The waste bin according to claim 5, further comprising a cam curve for said at least one plate exists in at least one of said side walls, and said at least one plate having a follower co-operating with said cam curve.

9. The waste bin according to claim 1, wherein said at least one plate extends horizontally in its closed and re-closed position.

10. The waste bin according to claim 1, wherein said at least one plate slopes downwardly from the front or rear wall in its closed and re-closed position.

11. The waste bin according to claim 1, further comprising drive means for said at least one plate; said drive means being supported by a side wall and including at least one electric motor.

12. The waste bin according to claim 11, wherein said drive means are controlled by electronic control means.

13. The waste bin according claim 1, wherein the compacting means include two plates rotating in opposite directions during their movement from closed to re-closed position.

14. The waste bin according to claim 1, wherein said lower compartment includes a removable container.

15. The waste bin according to claim 14, wherein said removable container can be taken away from the bin after opening or displacement of a lower portion of the front or rear wall.

16. The waste bin according to claim 1, wherein the entire movement of the compacting means between closed and re-closed position takes place within said upper compartment.

* * * * *